US012005292B1

(12) United States Patent
Smith, Jr.

(10) Patent No.: US 12,005,292 B1
(45) Date of Patent: Jun. 11, 2024

(54) BARBELL ADAPTER WITH LINKAGE CONNECTORS

(71) Applicant: Alfred Sidney Smith, Jr., Sammamish, WA (US)

(72) Inventor: Alfred Sidney Smith, Jr., Sammamish, WA (US)

( * ) Notice: Subject to any disclaimer, the term of this patent is extended or adjusted under 35 U.S.C. 154(b) by 82 days.

(21) Appl. No.: 17/943,017

(22) Filed: Sep. 12, 2022

Related U.S. Application Data

(60) Provisional application No. 63/242,923, filed on Sep. 10, 2021.

(51) Int. Cl.
*A63B 21/072* (2006.01)

(52) U.S. Cl.
CPC ..... *A63B 21/0724* (2013.01); *A63B 21/0728* (2013.01)

(58) Field of Classification Search
CPC ..... A63B 21/0724; A63B 21/0728; A63B 21/075
See application file for complete search history.

(56) References Cited

U.S. PATENT DOCUMENTS 5,029,849 A * 7/1991 Nurkowski ..... A63B 21/072 482/106
5,891,004 A * 4/1999 Berry ..... A63B 21/04 482/106
7,841,970 B2 * 11/2010 Striar ..... A63B 21/0728 482/99
9,504,869 B2 * 11/2016 Gavigan ..... A63B 21/0728
10,384,096 B1 * 8/2019 Aery ..... A63B 21/075
11,040,233 B2 * 6/2021 Sands ..... A63B 21/0724
11,123,594 B2 * 9/2021 Anderson ..... A63B 21/0728
2008/0051262 A1 * 2/2008 Striar ..... A63B 21/075 482/93
2019/0118026 A1 * 4/2019 D'Alesio ..... A63B 21/0442
2019/0269960 A1 * 9/2019 Barrow ..... A63B 21/4043
2020/0023225 A1 * 1/2020 Sands ..... A63B 21/16

* cited by examiner

*Primary Examiner* — Joshua Lee
(74) *Attorney, Agent, or Firm* — QuickPatents; Kevin Prince

(57) ABSTRACT

A rigid adapter for use with a barbell and one or more linkages that each have a first end and a second end, such as chains, elastomeric straps, safety looped nylon straps, or the like. The adapter includes a split collar that has an aperture therethrough adapted to receive the barbell, and two halves that each have a threaded aperture. One or more connection bolts are adapted to engage the threaded aperture of one of the halves of the split collar and include a linkage connection adapted for connecting with one of the linkages. Such a connection bolt may be an eye bolt, a J-shaped hook, a rectangular shaped hook, or the like. A resistance band buckle is fixed with the split collar and terminate at a resistance band connector. A spin collar can be used to allow the split collar to rotate on the barbell.

20 Claims, 10 Drawing Sheets

BARBELL ADAPTER WITH LINKAGE CONNECTORS

CROSS-REFERENCE TO RELATED APPLICATIONS

This application claims the benefit of U.S. Provisional Patent Application 63/242,923, filed on Sep. 10, 2021, and is incorporated herein by reference.

STATEMENT REGARDING FEDERALLY SPONSORED RESEARCH AND DEVELOPMENT

Not Applicable.

FIELD OF THE INVENTION

This invention relates to weight lifting exercises, and more particularly to a barbell adapter for use with resistance bands and chains.

BACKGROUND

Barbells are frequently used to train with resistance bands. Fixed connection points on the bar are typically used that ultimately limit the size of the bar or types of resistance bands, or resistance that can be used with the bar. Similar solutions use cloth and D-rings, but those are also secured to a fixed point on the bar and aren't designed for heavy forms of resistance.

Further, such prior art does not allow for multiple linkages to be fixed with each side of the barbell simultaneously, such as safety straps for bench pressing along with resistance bands for adding additional resistance for the exerciser. Moreover, such prior art does not allow the barbell to rotate with respect to the linkages, as is helpful to avoid torque being introduced by the linkages.

Therefore, there is a need for a versatile adapter device that allows connection of one or more linkages to the barbell, such linkages being metallic chains, elastomeric cords or straps, non-elastic nylon safety straps, or the like. Such a needed invention would allow for many different uses with the barbell and also with existing exercise equipment. Such a needed device would be relatively inexpensive to manufacture and intuitive to use, and would provide for options such as the linkages being rotatable about the barbell to prevent torque buildup on the barbell, safety straps for bench pressing exercises, and the like. The present invention accomplishes these objectives.

SUMMARY OF THE INVENTION

The present device is a rigid adapter for use with a barbell having two or more weights mounted thereto. The adapter is used with one or more linkages that each have a first end and a second end. An exerciser may further utilize the adapter in combination with exercise equipment, such as a bench press arrangement or the like.

The adapter includes a split collar that has an aperture therethrough adapted to receive the barbell therewithin. The split collar includes a first half that has one half of the aperture defined by an inside surface, and two opposing end each having a fastening aperture therethrough. The split collar includes a second half that has an opposing half of the aperture defined by an inside surface, and two opposing ends each having a threaded recess.

The two halves when brought together around the barbell are tightened to the barbell with two threaded bolts that traverse the fastening apertures on each end of the first half to engage the threaded recesses of the second half. Each half of the split collar has a threaded aperture traversing from an outside surface to the aperture and the inside surfaces, respectively. Preferably the threaded aperture is disposed at a center point between each end of each half. In some embodiments, the halves of the split collar are identical.

One or more connection bolts each have at a first end a threaded shaft that is adapted to engage the threaded aperture of one of the halves of the split collar. Each connection bolt further includes at a second end a linkage connection adapted for connecting with either of the first end or the second end of one of the linkages. Each connection bolt may be adapted to traverse the threaded aperture of either half of the split collar to tighten against the barbell within the aperture. Such a connection bolt may be an eye bolt, a J-shaped hook, a rectangular shaped hook that accommodates elastomeric resistance strap type linkages, or the like.

As such, in use, with the split collar fastened around the barbell, and with the linkage connection of one of the connection bolts connected with either the first end or the second end of one of the linkages, the barbell can be used for exercising with the linkage adding additional resistance to the exercises.

In some embodiments, a resistance band buckle is included that is adapted to be fixed with one of the halves of the split collar with one or more mechanical fasteners at a top end of the resistance band buckle. The resistance band buckle terminates at a resistance band connector at a bottom end of the resistance band buckle.

In some embodiments, a spin collar is further included that is fixed with the barbell. The spin collar includes an annular groove around which the split collar is fastened. A diameter of the aperture of the split collar is larger than a diameter of the annular groove, such that when the halves of the split collar are fully fastened together, the split collar is free to rotate within the annular groove of the spin collar.

In some embodiments, a plurality of linkages are included with the split collar, while in other embodiments the linkages are sold separately. Such linkages may include metallic chains, elastomeric resistance bands or cords, elastomeric resistance straps, or the like.

In some embodiments, at least one of the linkages is a non-elastic strap having a plurality of loops formed therein. When connected between the split collar and a bar supported by the exercise equipment, the bar is able to hold-up the barbell and the weights with the strap by fitting the bar through one of the plurality of loops of the strap. As such, the length of the strap between the bar and the split collar is adjusted to a maximum safe length for the exerciser to perform bench press exercises with the barbell and weights until failure, without the barbell being able to injure the exerciser. Preferably such a strap includes a nylon webbing material that is substantially inelastic.

The present invention is a versatile adapter device that allows connection of one or more linkages to a barbell, such linkages being metallic chains, elastomeric cords or straps, non-elastic nylon safety straps, or the like. The present invention allows for many different uses with the barbell and also with existing exercise equipment. The present device is relatively inexpensive to manufacture and intuitive to use, and provides for options such as the linkages being rotatable about the barbell, safety straps for bench pressing exercises that can prevent asphyxiation due to heavy barbells compressing an exerciser's neck, and the like. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
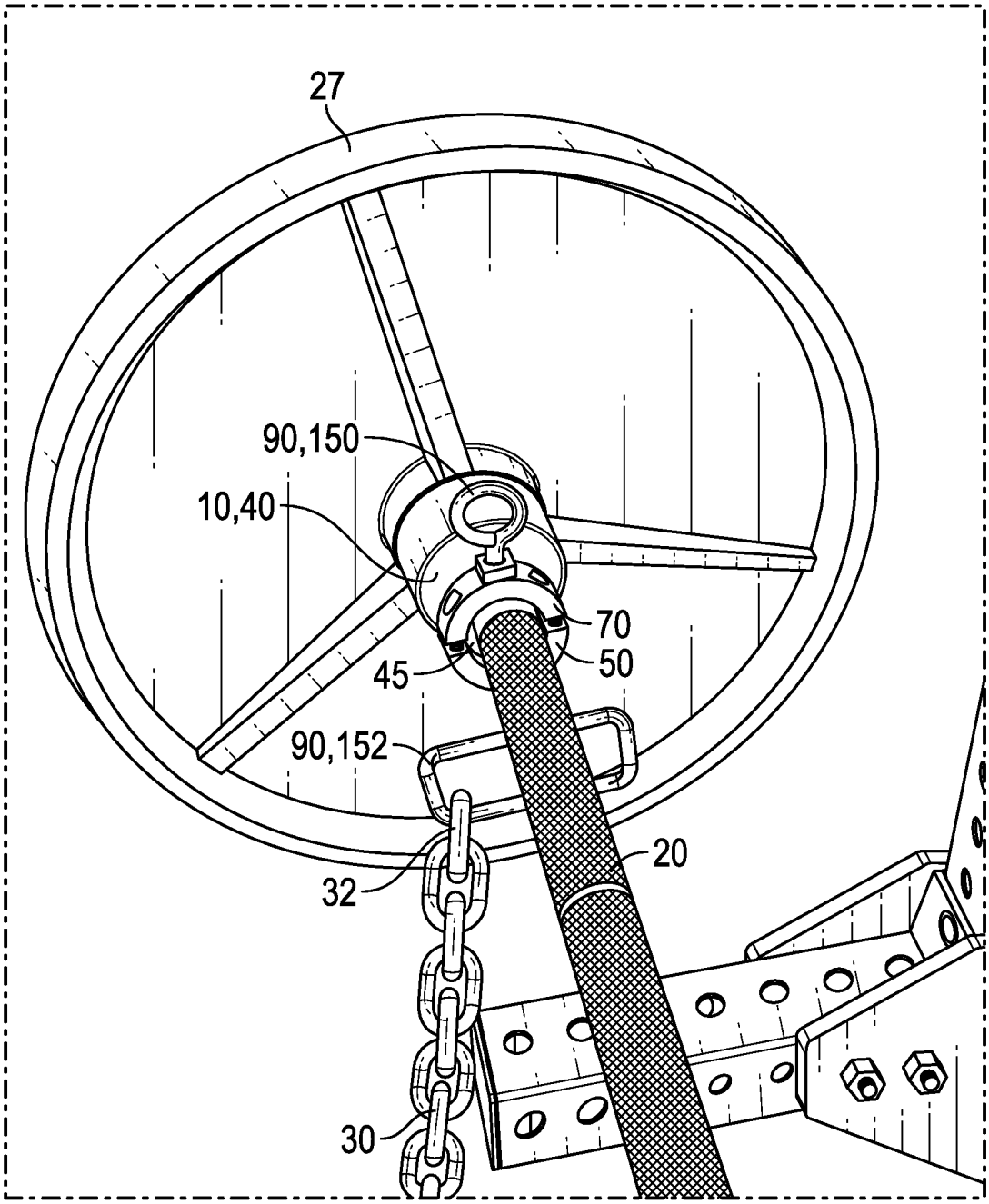
FIG. 1 is a perspective view of the invention as fitted onto a barbell along with a weight.
Figure 2:
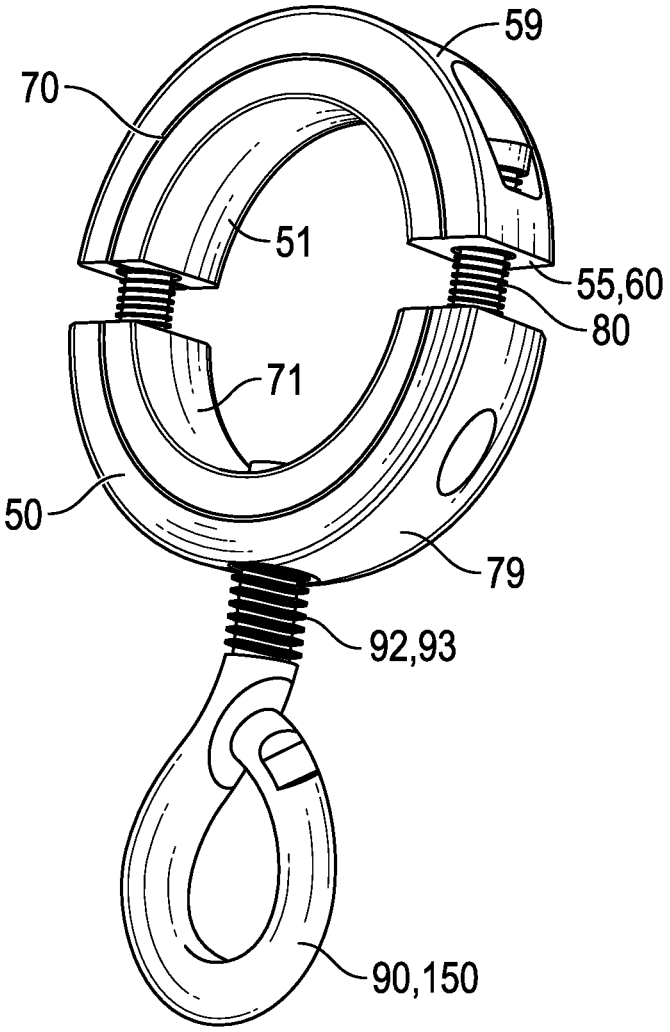
FIG. 2 is a perspective view of the invention, illustrating a split collar having a first half and a second half bolted together and including a connection bolt.
Figure 3:
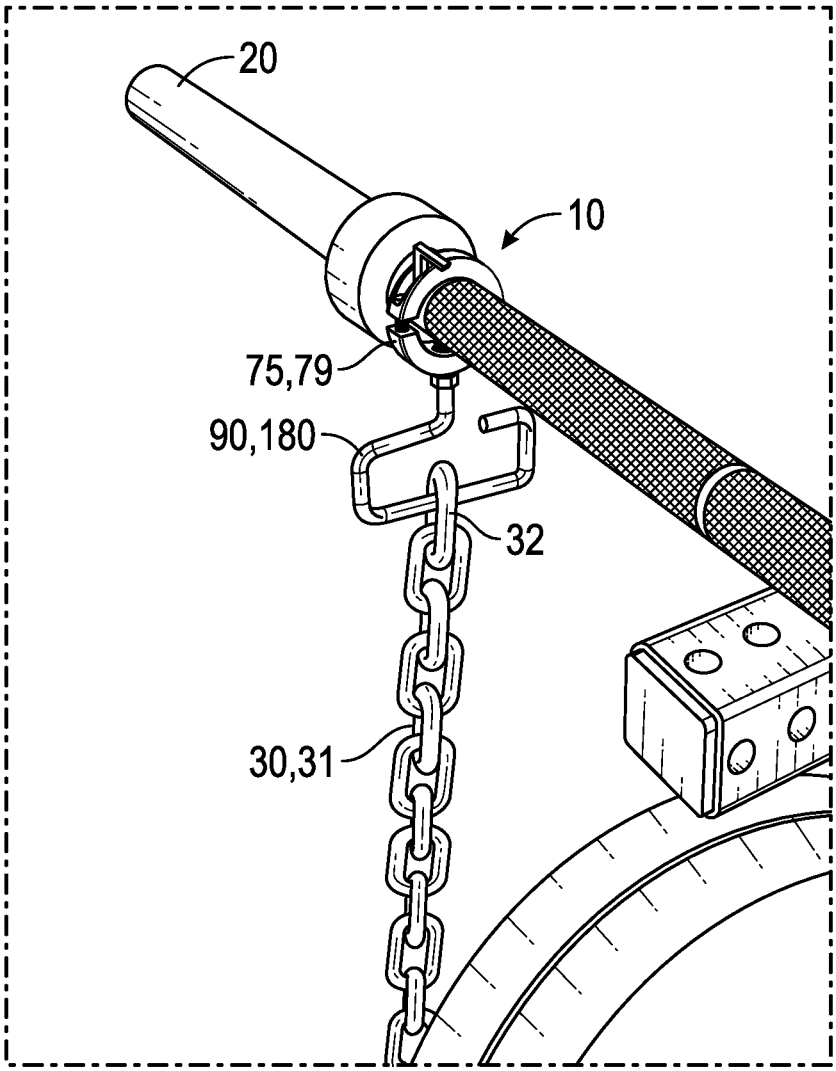
FIG. 3 is a perspective view of an alternate connection bolt used with a metallic chain type of linkage to increase the resistance to an exerciser.
Figure 4:
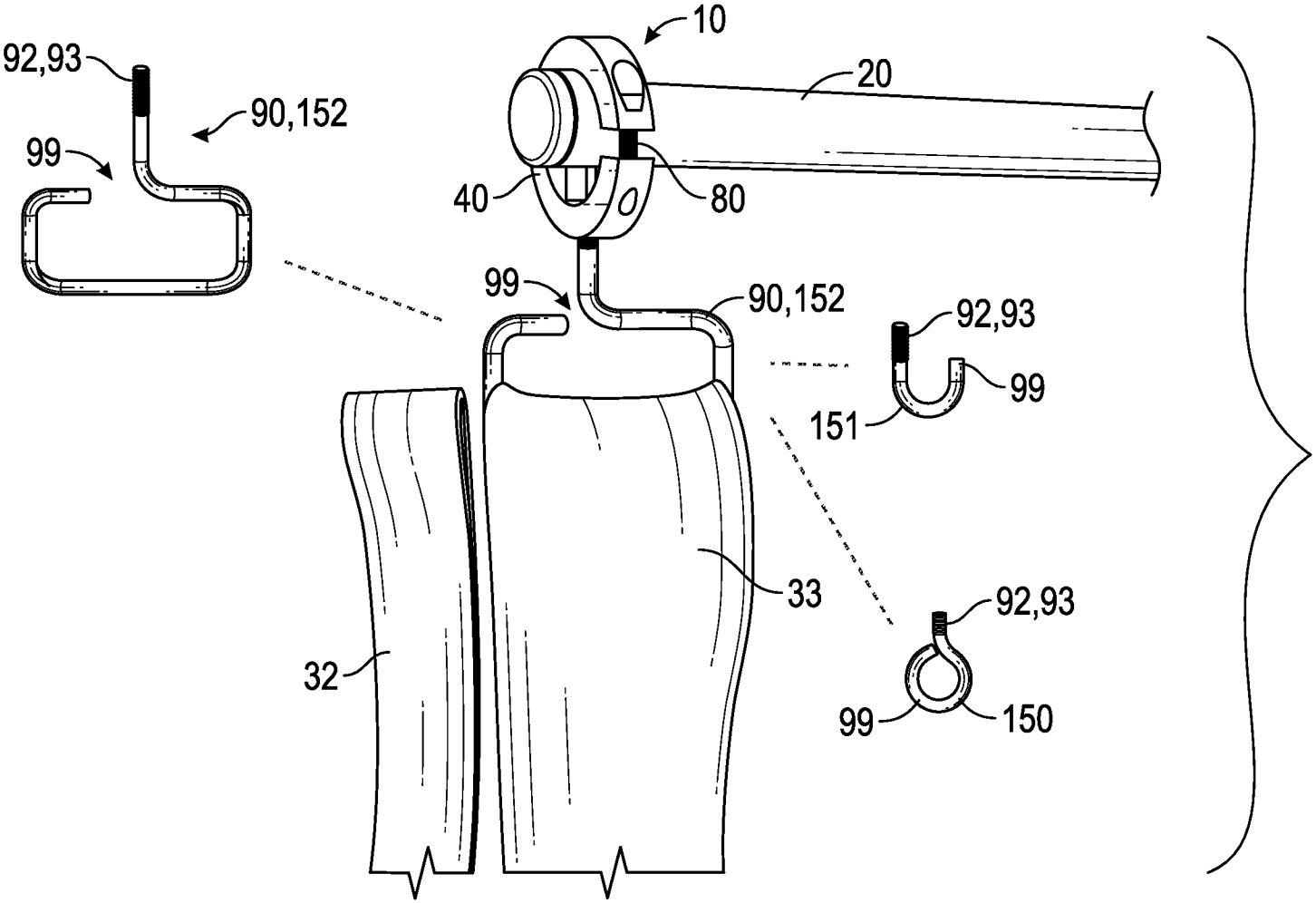
FIG. 4 is an exploded view showing a variety of types of connection bolts.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a rigid adapter 10 for use with a barbell 20 having two or more weights 27 mounted thereto. The adapter 10 is used with one or more linkages 30 that each have a first end 32 and a second end 38. An exerciser 15 (FIG. 7) may further utilize the adapter 10 in combination with exercise equipment 16, such as a bench press arrangement or the like.

The adapter 10 includes a split collar 40 that has an aperture 45 therethrough adapted to receive the barbell 20 therewithin. The split collar 40 includes a first half 50 that has one half of the aperture 45 defined by an inside surface 51, and two opposing end 55 each having a fastening aperture 60 therethrough. The split collar 40 includes a second half 70 that has an opposing half of the aperture 45 defined by an inside surface 71, and two opposing ends 75 each having a threaded recess 79. In an alternate embodiment of the split collar 40, one of the ends 55 of the first half 50 is hinged to one of the ends 75 of the second half 70, and the opposing unhinged ends 55,75 are adapted to be selectively locked together.

Figure 6A:
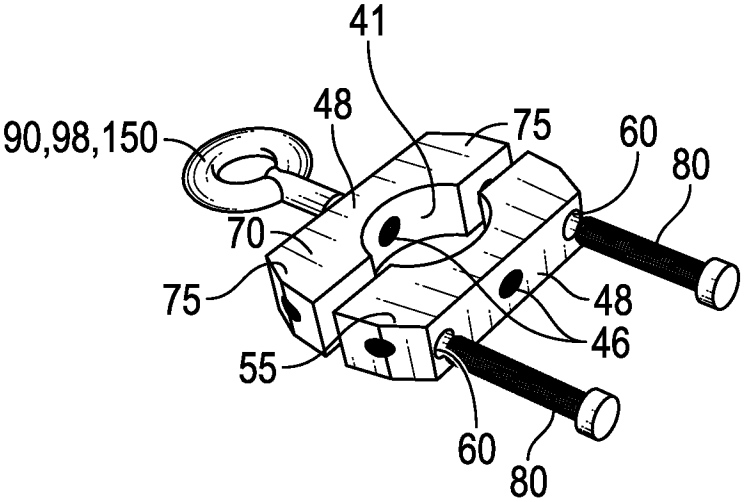
FIG. 6A is a partially exploded perspective view of an alternate type of split collar.

The two halves 50,70 when brought together around the barbell 20 are tightened to the barbell 20 with two threaded bolts 80 that traverse the fastening apertures 60 on each end 55 of the first half 50 to engage the threaded recesses 79 of the second half 70. Each half 50,70 of the split collar 40 has a threaded aperture 46 traversing from an outside surface 48 (FIG. 6A) to the aperture 45 and the inside surfaces 51,71, respectively. Preferably the threaded aperture 46 is disposed at a center point between each end 55,75 of each half 50,70. In some embodiments, the halves 50,70 of the split collar 40 are identical.

One or more connection bolts 90 each have at a first end 92 a threaded shaft 93 that is adapted to engage the threaded aperture 46 of one of the halves 50,70 of the split collar 40. Each connection bolt 90 further includes at a second end 98 a linkage connection 99 adapted for connecting with either of the first end 32 or the second end 38 of one of the linkages 30. Each connection bolt 90 may be adapted to traverse the threaded aperture 46 of either half 50,70 of the split collar 40 to tighten against the barbell 20 within the aperture 45. A cap (not shown) may be placed around the first end 92 to inhibit damage of the barbell 20 by the connection bolt 90.

Such a connection bolt 90 may be an eye bolt 150, a J-shaped hook 151, a rectangular shaped hook 152 that accommodates elastomeric resistance strap 33 type linkages 30, or the like.

As such, in use, with the split collar 40 fastened around the barbell 20, and with the linkage connection 99 of one of the connection bolts 90 connected with either the first end 32 or the second end 38 of one of the linkages 30, the barbell 20 can be used for exercising with the linkage 30 adding additional resistance to the exercises.

Figure 6B:
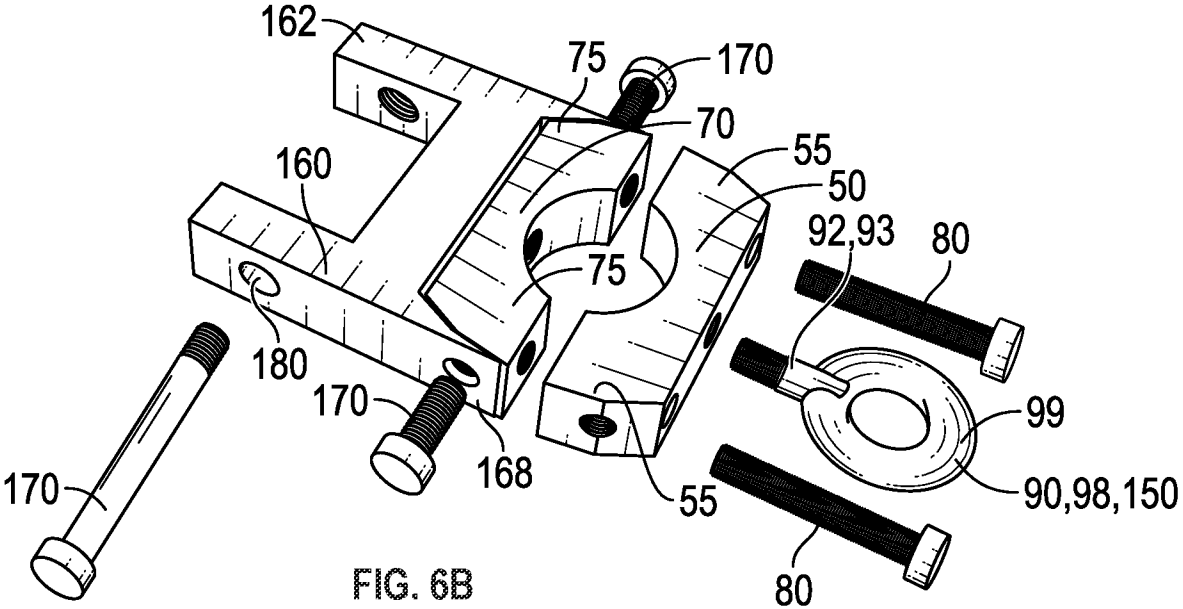
FIG. 6B is a partially exploded perspective view of the split collar of FIG. 6A but further including a resistance band buckle.

In some embodiments, a resistance band buckle 160 (FIG. 6B) is included that is adapted to be fixed with one of the halves 50,70 of the split collar 40 with one or more mechanical fasteners 170 at a top end 168 of the resistance band buckle 160. The resistance band buckle 160 terminates at a resistance band connector 180 at a bottom end 162 of the resistance band buckle 160. Such a resistance band connector 180 may take the form of the buckle (#30) in my previous U.S. Pat. No. 10,463,905, issued on Nov. 5, 2019, for example.

Figure 8A:
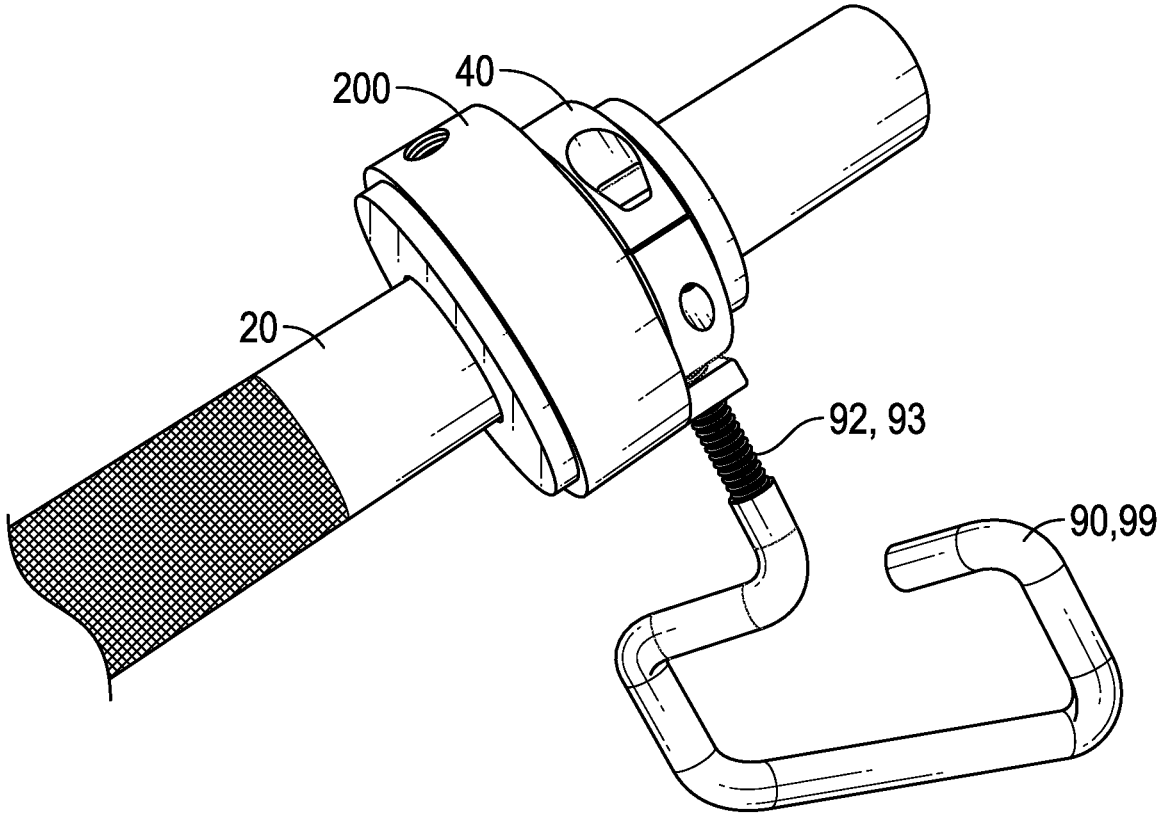
FIG. 8A is a perspective view of an alternate embodiment having a spin collar around which the split collar is able to rotate.
Figure 8B:
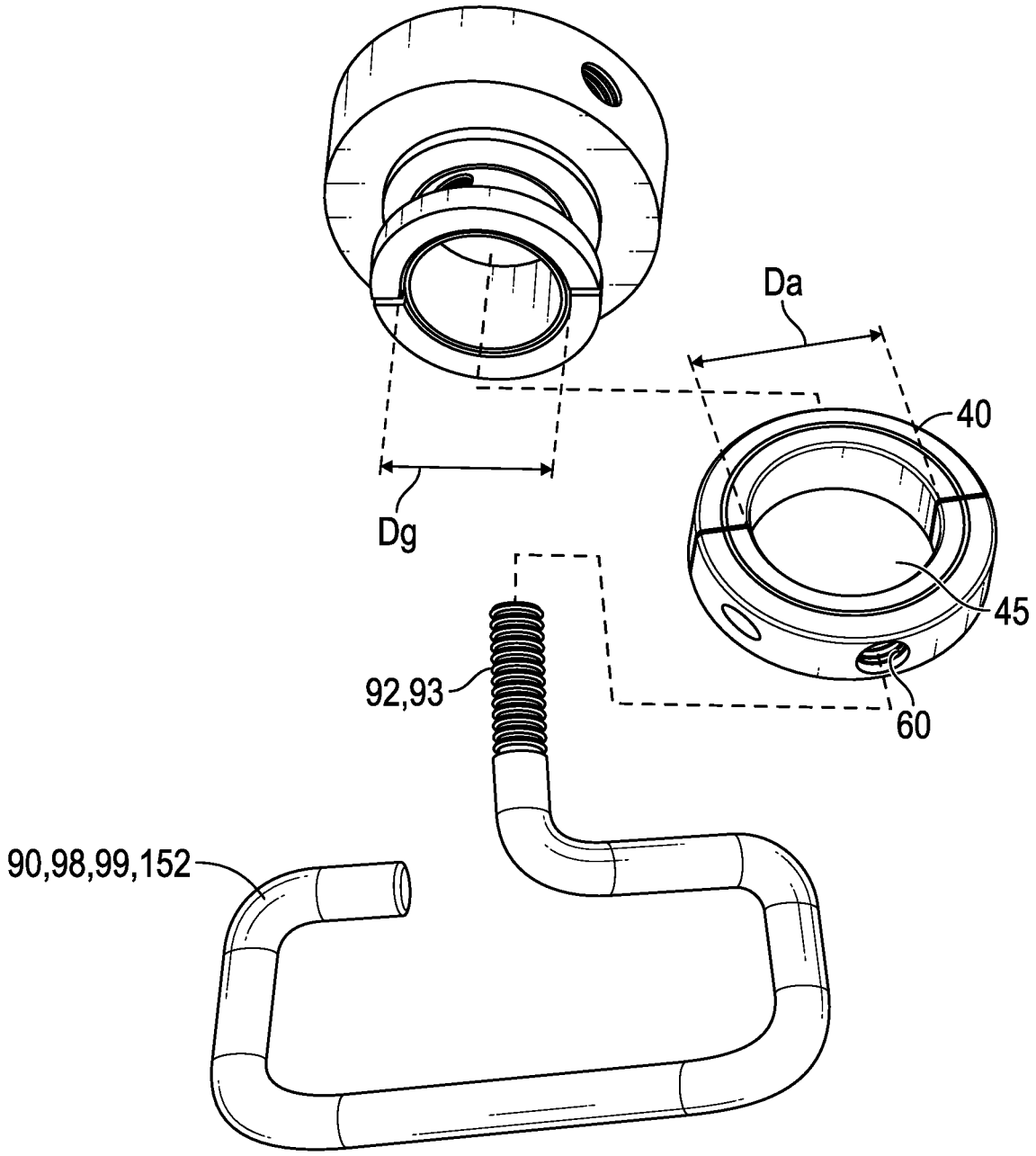
FIG. 8B is an exploded perspective view of the embodiment of FIG. 8A.

In some embodiments, a spin collar 200 (FIGS. 8A-8B) is further included that is fixed with the barbell 15 such as with a setscrew or bolt as is known in the art. The spin collar 200 includes an annular groove 210 around which the split collar 40 is fastened. A diameter D. of the aperture 45 of the split collar 40 is larger than a diameter D g of the annular groove 210, when the halves 50,70 of the split collar 40 are fully fastened together, such that the split collar 40 is free to rotate within the annular groove 210 of the spin collar 200.

In some embodiments, a plurality of linkages 30 are included with the split collar 40, while in other embodiments the linkages 30 are sold separately. Such linkages 30 may include metallic chains 31, elastomeric resistance bands or cords 32 (FIG. 4), elastomeric resistance straps 33, or the like.

Figure 5A:
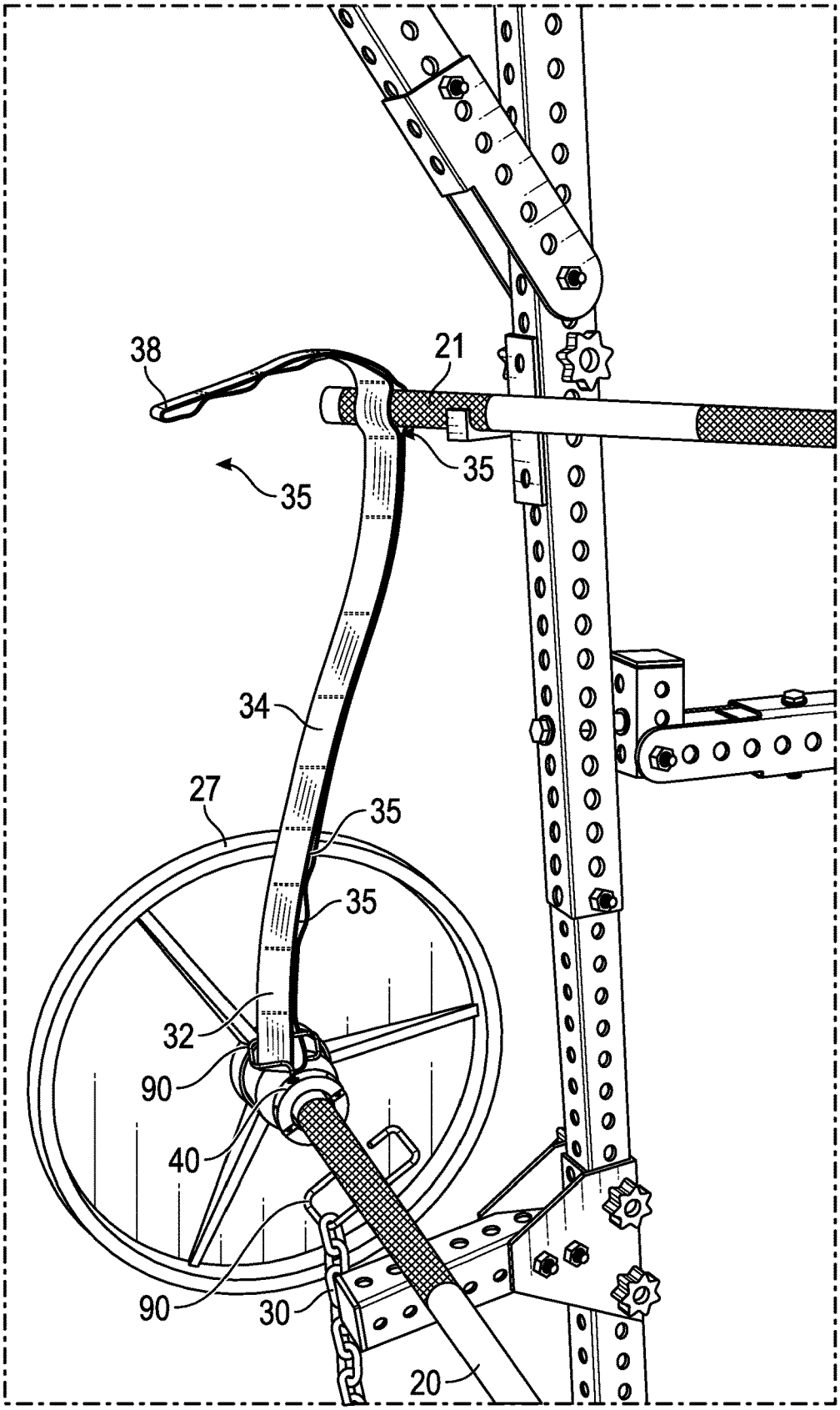
FIG. 5A is a perspective view of an alternate type of linkage designed to safeguard an exerciser doing bench press type exercises.
Figure 5B:
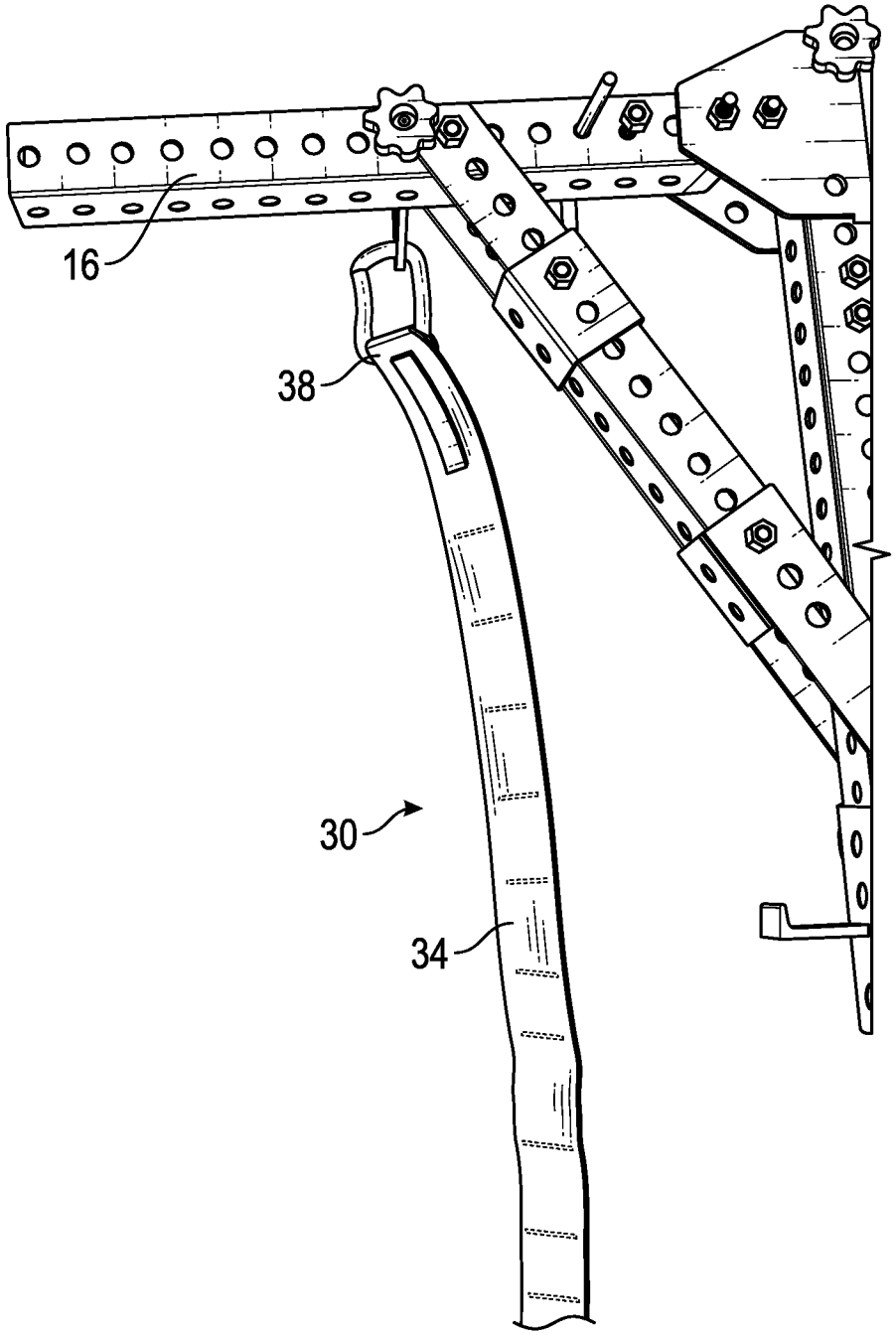
FIG. 5B is a partial perspective view of an alternate attachment of the linkage of FIG. 5A.
Figure 7:
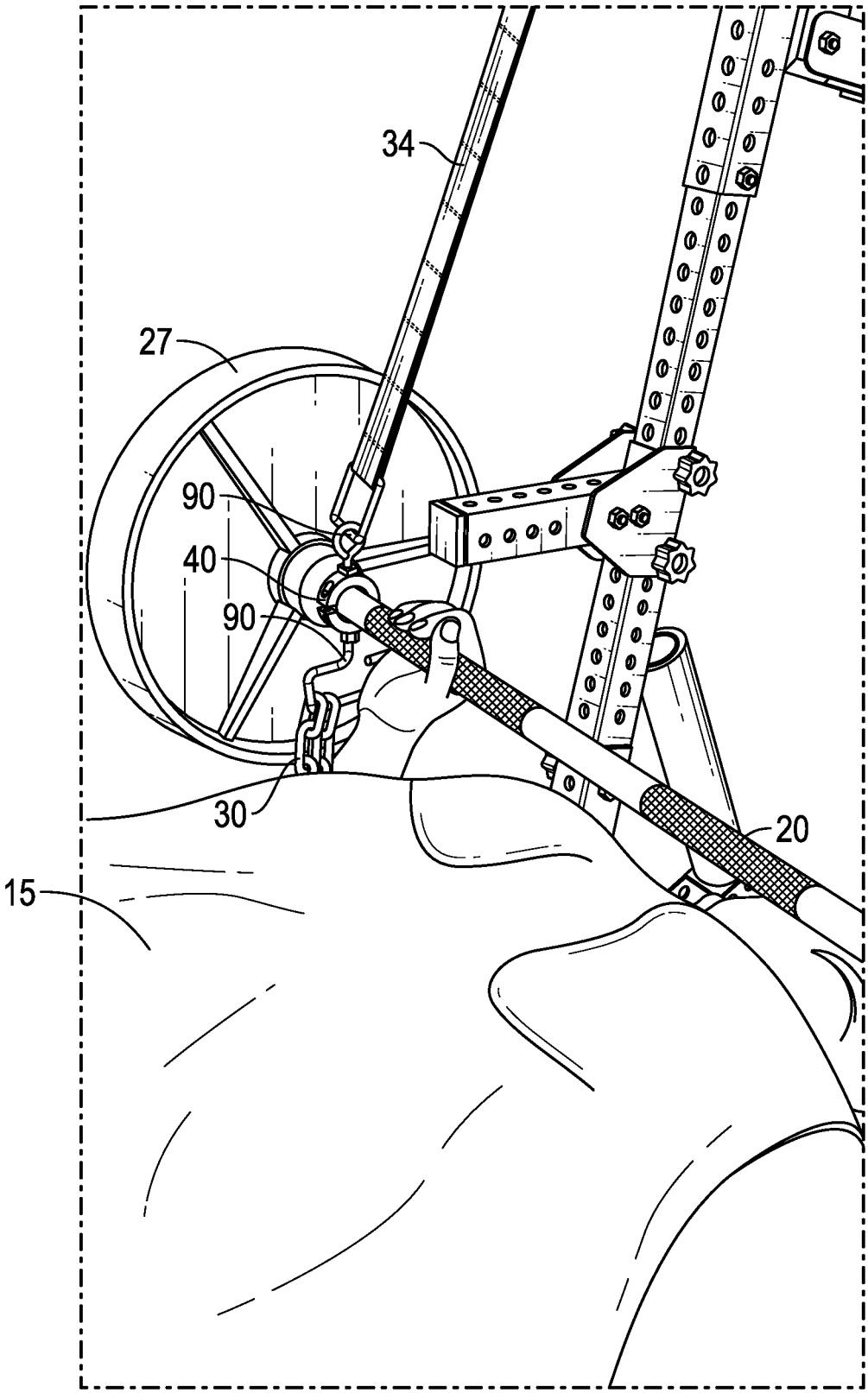
FIG. 7 is a perspective view showing the embodiment of FIGS. 5A and 5B in-use wherein the exerciser has failed to lift the barbell but is still protected.

In some embodiments, at least one of the linkages 30 is a non-elastic strap 34 (FIGS. 5A, 5B, and 7) having a plurality of loops 35 formed therein. When connected between the split collar 40 and a bar 21 supported by the exercise equipment 16, the bar 21 is able to hold-up the barbell 20 and the weights 27 with the strap 34 by fitting the bar 21 through one of the plurality of loops 35 of the strap 30. As such, the length of the strap 34 between the bar 21 and the split collar 40 is adjusted to a maximum safe length for the exerciser to perform bench press exercises with the barbell 20 and weights 27 until failure, without the barbell 20 being able to injure the exerciser 15 (FIG. 7). Preferably such a strap 34 includes a nylon webbing material that is substantially inelastic.

The adapter 10 may be used in various ways with barbells 20, shorter hand bars (not shown), or other exercise equipment 16 wherein connecting one or more of the linkages 30 can enhance the exercising experience. While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An adapter for use with a barbell having two or more weights mounted thereto, and for use with one or more linkages each having a first end and a second end, the adapter comprising:

a split collar having an aperture therethrough adapted to receive the barbell therewithin, the split collar including a first half having one half of the aperture on an inside surface and two ends each having a fastening aperture therethrough, the split collar including a second half having an opposing half of the aperture on an inside surface and two ends each having a threaded recess, the two halves when brought together around the barbell being tightened to the barbell with two threaded bolts that traverse the fastening apertures on each end of the first half to engage the threaded recesses of the second half, each half of the split collar having a threaded aperture traversing from an outside surface to the inside surface;

one or more connection bolts each having at a first end a threaded shaft adapted to engage the threaded aperture of one of the halves of the split collar, and at a second end a linkage connection adapted for connecting with either of the first end or the second end of one of the linkages;

whereby with the split collar fastened around the barbell, and with the linkage connection of the connection bolt connected with either the first end or the second end of the linkage, the barbell can be used for exercising with the linkage adding additional resistance to the exercises.

2. The adapter of claim 1 wherein the first half of the split collar and the second half of the split collar are identical.

3. The adapter of claim 1 wherein the connection bolt is adapted to traverse the threaded aperture of either half of the split collar to tighten against the barbell.

4. The adapter of claim 1 wherein at least one of the connection bolts is an eye bolt.

5. The adapter of claim 1 wherein at least one of the connection bolts includes a J-shaped hook.

6. The adapter of claim 1 wherein at least one of the connection bolts includes a rectangular shaped hook.

7. The adapter of claim 1 further including a resistance band buckle that is adapted to be fixed with one of the halves of the split collar with one or more mechanical fasteners at a top end thereof, and terminating at a resistance band connector at a bottom end thereof.

8. The adapter of claim 1 further including a spin collar adapted for fixing with the barbell, the spin collar including an annular groove around which the split collar is fastened, the diameter of the aperture of the split collar being larger than a diameter of the annular groove, such that with the two halves of the split collar fastened together, the split collar is free to rotate within the trench of the spin collar.

9. An adapter for use with a barbell having two or more weights mounted thereto, the adapter comprising:

one or more linkages each having a first end and a second end;

a split collar having an aperture therethrough adapted to receive the barbell therewithin, the split collar including a first half having one half of the aperture on an inside surface and two ends each having a fastening aperture therethrough, the split collar including a second half having an opposing half of the aperture on an inside surface and two ends each having a threaded recess, the two halves when brought together around the barbell being tightened to the barbell with two threaded bolts that traverse the fastening apertures on each end of the first half to engage the threaded recesses of the second half, each half of the split collar having a threaded aperture traversing from an outside surface to the inside surface;

one or more connection bolts each having at a first end a threaded shaft adapted to engage the threaded aperture of one of the halves of the split collar, and at a second end a linkage connection adapted for connecting with either of the first end or the second end of one of the linkages;

whereby with the split collar fastened around the barbell, and with the linkage connection of the connection bolt connected with either the first end or the second end of the linkage, the barbell can be used for exercising with the linkage adding additional resistance to the exercises.

10. The adapter of claim 9 wherein the first half of the split collar and the second half of the split collar are identical.

11. The adapter of claim 9 wherein the connection bolt is adapted to traverse the threaded aperture of either half of the split collar to tighten against the barbell.

12. The adapter of claim 9 wherein at least one of the connection bolts is an eye bolt.

13. The adapter of claim 9 wherein at least one of the connection bolts includes a J-shaped hook.

14. The adapter of claim 9 wherein at least one of the connection bolts includes a rectangular shaped hook.

15. The adapter of claim 9 further including a resistance band buckle that is adapted to be fixed with one of the halves of the split collar with one or more mechanical fasteners at a top end thereof, and terminating at a resistance band connector at a bottom end thereof.

16. The adapter of claim 9 further including a spin collar adapted for fixing with the barbell, the spin collar including an annular groove around which the split collar is fastened, the diameter of the aperture of the split collar being larger than a diameter of the annular groove, such that with the two halves of the split collar fastened together, the split collar is free to rotate within the trench of the spin collar.

17. The adapter of claim 9 wherein at least one of the linkages includes a metallic chain.

18. The adapter of claim 9 wherein at least one of the linkages includes an elastomeric resistance band.

19. The adapter of claim 9 wherein at least one of the linkages includes an elastomeric resistance strap.

20. The adapter of claim 9 wherein at least one of the linkages includes a strap having a plurality of loops, whereby when connected between the split collar and a bar, the bar is able to hold up the barbell with the strap by fitting the bar through one of the plurality of loops of the strap.

* * * * *